United States Patent [19]

Fujikawa

[11] Patent Number: 4,545,314

[45] Date of Patent: Oct. 8, 1985

[54] CONTROL SYSTEM FOR SEWING MACHINES

[75] Inventor: Katsuhiro Fujikawa, Aichi, Japan

[73] Assignee: Mitsubishi Denki Kabushiki Kaisha, Tokyo, Japan

[21] Appl. No.: 560,079

[22] Filed: Dec. 9, 1983

[30] Foreign Application Priority Data

Dec. 9, 1982 [JP] Japan ..... 57-216225

[51] Int. Cl.[4] ..... D05B 69/26

[52] U.S. Cl. ..... 112/275

[58] Field of Search ..... 112/275, 277, 121.11, 112/67, 87; 318/369

[56] References Cited

U.S. PATENT DOCUMENTS 4,137,860 2/1979 Yoneji et al. ..... 112/277
4,173,193 11/1979 Morinaga et al. ..... 112/275

FOREIGN PATENT DOCUMENTS 2412895 3/1974 Fed. Rep. of Germany .
2521483 5/1975 Fed. Rep. of Germany .
2801456 1/1978 Fed. Rep. of Germany .

*Primary Examiner*—Peter Nerbun
*Attorney, Agent, or Firm*—Sughrue, Mion, Zinn, Macpeak & Seas

[57] ABSTRACT

A control system for stopping the operation of a sewing machine at a prescribed stop position includes a detector for generating signals indicative of detected positions of a needle of the sewing machine and a signal indicative of a detected speed of operation of the sewing machine. A control device stops the operation of the sewing machine in response to one of the signals indicative of the needle positions when the speed of operation of the sewing machine reaches a predetermined stop-ready speed. The control device has a selector for selecting either one of the options of detecting the stop-ready speed reached by the speed of operation of the sewing machine with a program stored in the control device and with one of the signals from the detector. The detector can thus detect stop-ready speeds for different sewing machine types without changing the program stored in the control device.

5 Claims, 5 Drawing Figures

CONTROL SYSTEM FOR SEWING MACHINES

BACKGROUND OF THE INVENTION

The present invention relates to a control system for a sewing machine, and more particularly to a control system capable of stopping the operation of a sewing machine at a desired stop position.

While a fabric is being stitched on a sewing machine in a continuous stitch pattern, for example, it is sometimes necessary to change the direction of stitching. When such a need arises, the operator usually stops the operation of the sewing machine and then changes the direction of stitching. At this time, the operation of the sewing machine should be stopped at a prescribed position since an irregular stitch pattern would otherwise be formed on the fabric. It is also required to stop the sewing needle at a prescribed position when the thread is to be cut after the sewing operation has been finished. Therefore, the sewing machine should be provided with an ability to stop its operation at a prescribed position.

When, however, the sewing machine is being operated at a high speed during the stitching process, the operation of the sewing machine cannot be stopped at the prescribed position merely by deactivating the sewing machine at the prescribed position. It is necessary in such a case to stop the operation of the sewing machine only after the speed of operation thereof has been reduced in preparation for stopping.

FIG. 1 of the accompanying drawings illustrates a previously proposed speed control system which will effect such an operation. This speed control system has a control circuit 10 implemented with a microcomputer including a read-only memory, a random-access memory, and other elements. The control circuit 10 is supplied with an operation command signal $S_1$, an upper needle position signal UP indicative of an upper needle position, and a lower needle position signal DN indicative of a lower needle position. The signals UP and DN are provided by a detector (not shown) associated with the rotational shaft of the sewing machine (not shown).

The speed control system also has a speed control unit (hereinafter referred to as an "SCU") 12 responsive to a command from the control circuit 10 for controlling a variable-speed motor (not shown) which drives the sewing machine to thereby effect speed control of the sewing machine. The SCU 12 is supplied with a variable-speed command voltage Vc and a speed detection signal PG from the aforementioned detector for controlling the energization coils of an electromagnetic brake BK and an electromagnetic clutch CL which are coupled to the motor.

Operation of the conventional speed control system shown in FIG. 1 will be described with reference to FIGS. 2 and 3. When the operation command signal $S_1$ in its active state, the control circuit 10 supplies an operation starting command signal to the SCU 12 which energizes the motor at speed determined by the variable-speed command voltage VC to thus start a stitching operation. When the stitching operation is started, the upper needle position signal UP, the lower needle position signal DN, and the speed detection signal PG are issued from the detector to the control circuit 10 and the SCU 12. The upper and lower needle position signals UP and DN applied to the control circuit 10 are employed as discrimination signals for stopping the operation of the sewing machine in upper and lower needle positions when the operation command signal $S_1$ is eliminated (set to its inactive state).

The process in which the operation of the sewing machine is stopped in the lower needle position will now be described. If the BK coil were energized in response to the detection of the lower needle position signal DN immediately after the operation command signal $S_1$ is turned off, the position at which the operation of the sewing machine is stopped would vary widely with the speed of operation of the sewing machine, and hence the desired accuracy as to the position of stopping of the sewing machine could not be achieved. To avoid this, the control circuit 10 detects when the speed of operation of the sewing machine has been lowered to a predetermined speed (hereinafter referred to as a "stop-ready speed") at which a desired stopping accuracy can be achieved utilizing the lower needle position signal DN. The speed of operation of the sewing machine is reduced to the stop-ready speed under the control of the SCU 12 based on a command from the control circuit 10.

Whether the speed of operation of the sewing machine has reached the stop-ready speed or not can be determined by measuring, with the control circuit 10, a time $T_1$ after the lower needle position signal has been turned off and before it is next turned on, as shown in FIG. 2, and comparing the time $T_1$ with a predetermined time T. If the time $T_1$ is longer than the time T, then the speed of operation of the sewing machine is determined as being lower than the stop-ready speed.

The flowchart of a program for enabling the control circuit 10 to effect such a speed determination process is illustrated in FIG. 3.

The program includes a step 101 for determining whether the lower needle position signal DN as stored is on or off by ascertaining whether LDlF is "0" or "1". If LDlF=0, then the program goes to a next step 102 which determines whether the lower needle position signal DN is on or not. If the signal DN is off, then a preset time T is set in a step 103, and thereafter LDIF is set to "1" in a step 104.

A step 105 determines again whether the lower needle position signal DN is on or not. If the signal DN is off, then the program branches off to a step 106 in which an off-time $T_1$ is counted. If the signal DN is on, then LDlF is set to "0" in a step 107, and thereafter a step 108 determines whether the counted off-time $T_1$ is longer than the preset time T. If $T_1 \geqq T$, then the program goes to a step 109 in which LSDF is set to "1" otherwise LSDF is set equal to "0" in step 110. When LDDF is set to "1", the control circuit 10 supplies a command for energizing the BK coil to the SCU 12, which energizes the BK coil to brake the motor which drives the sewing machine, thus stopping the sewing machine at the lower needle position. If $T_1 > T$, then LSDF is set to 0, and the program returns to an initial state. If LDlF=1 in the step 101, then the program goes directly to the step 105. If the signal DN is on in the step 102, then the program goes back to the initial state. When off-time $T_1$ is counted or "YES" outputs are received from steps 102 and 110, the program returns to the main routine as shown by the step labeled "RETURN".

As shown in FIG. 2, the on-time is not counted in the step 108 during an interval in which the signal DN remains on, and the off-time starts being counted when the signal DN is shifted from the off-state to the on-state. The counting goes on until the signal DN is next turned on. When the signal DN is turned on, the measured off-time $T_1$ is compared with the preset time T. When $T_1=T$, that is, when the stop-ready speed is reached, the BK coil is energized to stop the operation of the sewing machine in the lower needle position.

The conventional sewing machine control system thus constructed has suffered from the following disadvantages: Where the lower needle position signal DN has a longer pulse duration in one complete revolution of the main shaft of a sewing machine in which the control system is incorporated, the measured $T_1$ tends to be shorter at all times than the time T preset by the program, resulting in a failure to detect the stop-ready speed. Where the lower needle position signal DN has a shorter pulse duration, the time $T_1$ is always longer than the preset time T, and the speed of operation is detected in error as being lower than the stop-ready speed regardless of the fact that the speed of operation is not lower than the stop-ready speed. The SCU 12 then issues a command to energize the BK coil at a time when the speed is too high for the sewing machine operation to stop accurately, with the result that the desired stopping accuracy is not accomplished.

SUMMARY OF THE INVENTION

With the foregoing prior difficulties in view, it is an object of the present invention to provide a sewing machine control system having a capability for selecting the option of detecting a stop-ready speed with a predetermined program or the option of detecting a stop-ready speed with an external signal, the selection being easily effected by the actuation of a selector switch, so that the control system is compatible for use with various sewing machine types having different pulse durations of needle position signals.

The above object is achieved by a sewing machine control system including a drive mechanism for driving a sewing machine, a brake mechanism for braking the sewing machine, control means for controlling the drive mechanism and the brake mechanism, and detector means for detecting needle positions of the sewing machine and generating at least one detection signal such as a speed detection signal. The control means has a selector switch for selecting the option of detecting a predetermined stop-ready speed reached by the sewing machine with a program stored in the control means, or the option of detecting such a stop-ready speed with an external signal issued from the detector means.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 4:
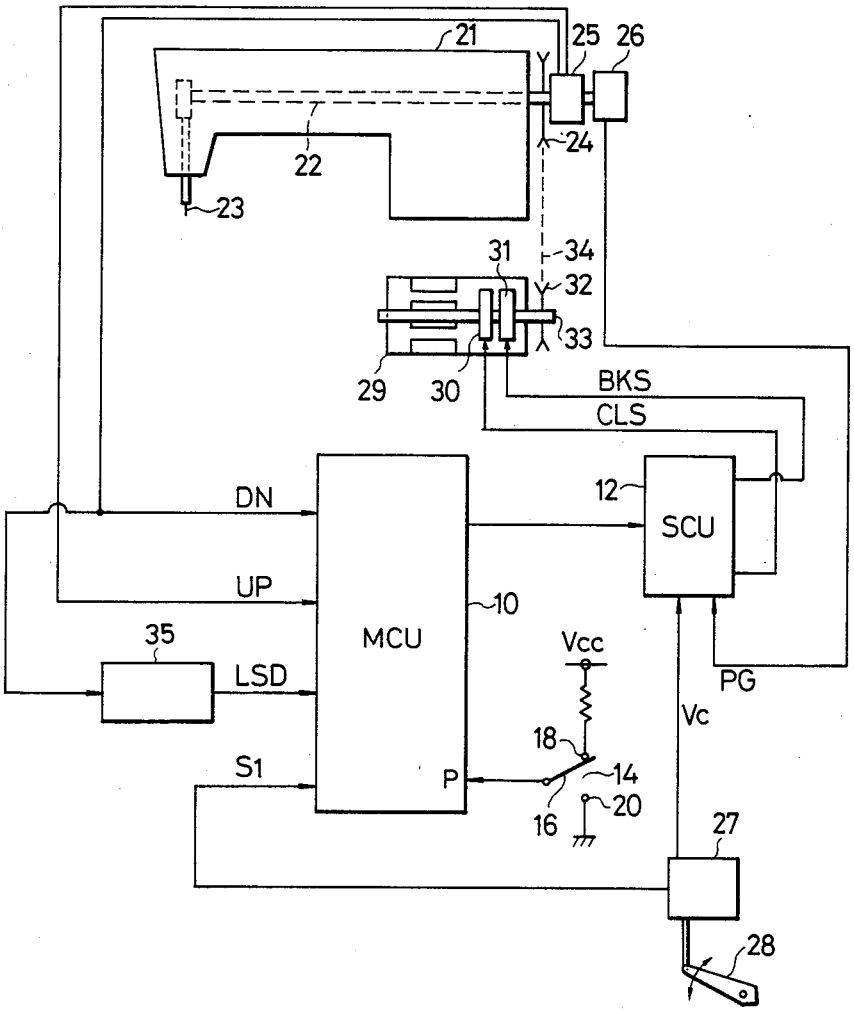
FIG. 4 is a block diagram of a sewing machine control system according to the present invention.

As shown in FIG. 4, a control system according to the present invention includes a control circuit 10 implemented as a microcomputer supplied with an operation command signal $S_1$, a lower needle position signal DN, an upper needle position signal UP, and an external stop-ready speed command signal (hereinafter referred to as an "external signal") LSD. The control circuit 10 has an input port P to which is connected a selector switch 14 for selecting the option of detecting a stop-ready speed with a program stored in the control circuit 10 or the option of detecting a stop-ready speed with the external signal LSD. The selector switch 14 has a movable contact 16 connected to the input port P of the control circuit 10, a fixed contact 18 connected to a power supply Vcc, and fixed contact 20 connected to ground.

Figure 1:
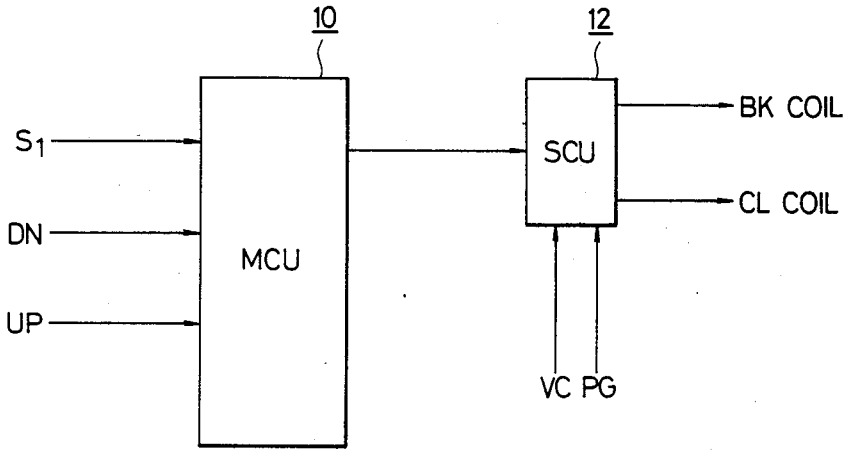
FIG. 1 PRIOR ART
FIG. 1 is a block diagram of a conventional sewing machine control system.
Figure 2:
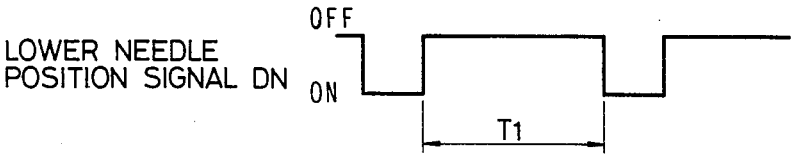
FIG. 2 is a diagram showing the waveform of a lower needle position signal, illustrative of the manner in which a stop-ready speed of a sewing machine is detected by the control system of FIG. 1.

The control circuit 10 detects a stop-ready speed according to the program stored therein using the same procedure described with reference to FIG. 1 when the movable contact 16 is shifted to the fixed contact 18. This switch movement will be referred to as "the selector switch 14 is turned off". When the movable contact 16 is brought into contact with the fixed contact 20, the control circuit 10 determines whether the speed of operation of the sewing machine is below a stop-ready speed or not by ascertaining whether the external signal LSD is on or off. This switch movement will be referred to as "the selector switch 14 is turned on".

A sewing machine 21 has a rotational shaft 22, a sewing machine mechanism 23 drivable up and down by the rotational shaft 22, and a pulley 24 attached to the rotational shaft 22. A position detector 25 is mounted on the rotational shaft 22 for detecting the rotational position thereof, and accordingly to issue lower and upper needle position signals DN and UP to the control circuit 10. A speed detector 26, mounted on the rotational shaft 22, responding to rotation of the rotational shaft 22 issues a speed detection signal PG to a speed control unit (hereinafter referred to as an "SCU") 12.

The control system includes a pedal detector circuit energizable in response to actuation of a pedal 28 for issuing an operation command signal $S_1$ and a speed command voltage Vc to the control circuit 10 and the SCU 12, respectively. A variable-speed motor 29 for driving the sewing machine 21 has a coil 30 for energizing an electromagnetic clutch CL and a coil 31 for energizing an electromagnetic brake BK, with the coils 30 and 31 being respectively controllable by control signals CLS and BKS supplied from the SCU 12.

The motor 29 has an output shaft 33 with a pulley 32 mounted thereon. A transmission belt 34 is laid around the pulleys 24 and 32.

An external stop-ready speed generator circuit 35 is connected to the control circuit 10 and supplied with the lower needle position signal DN from the position detector 25 for issuing the external signal LSD to the control circuit 10.

Operation of the control system illustrated in FIG. 4 will be described with reference to FIG. 5.

Figure 3:
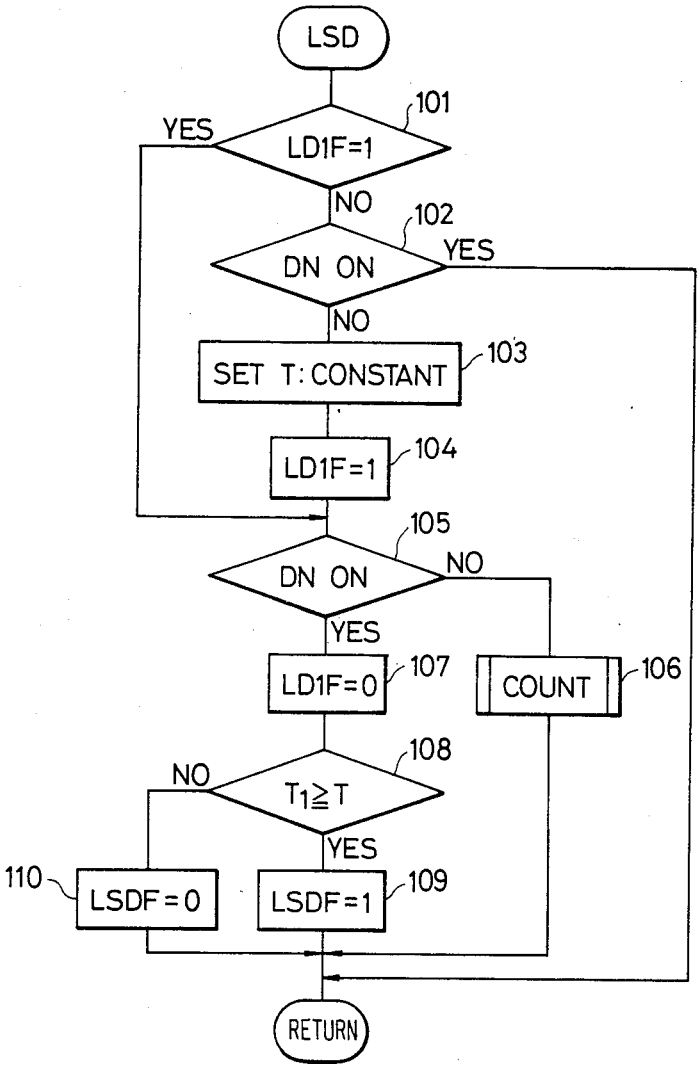
FIG. 3 is a flowchart of a program for detecting the stop-ready speed with the control system shown in FIG. 1.
Figure 5:
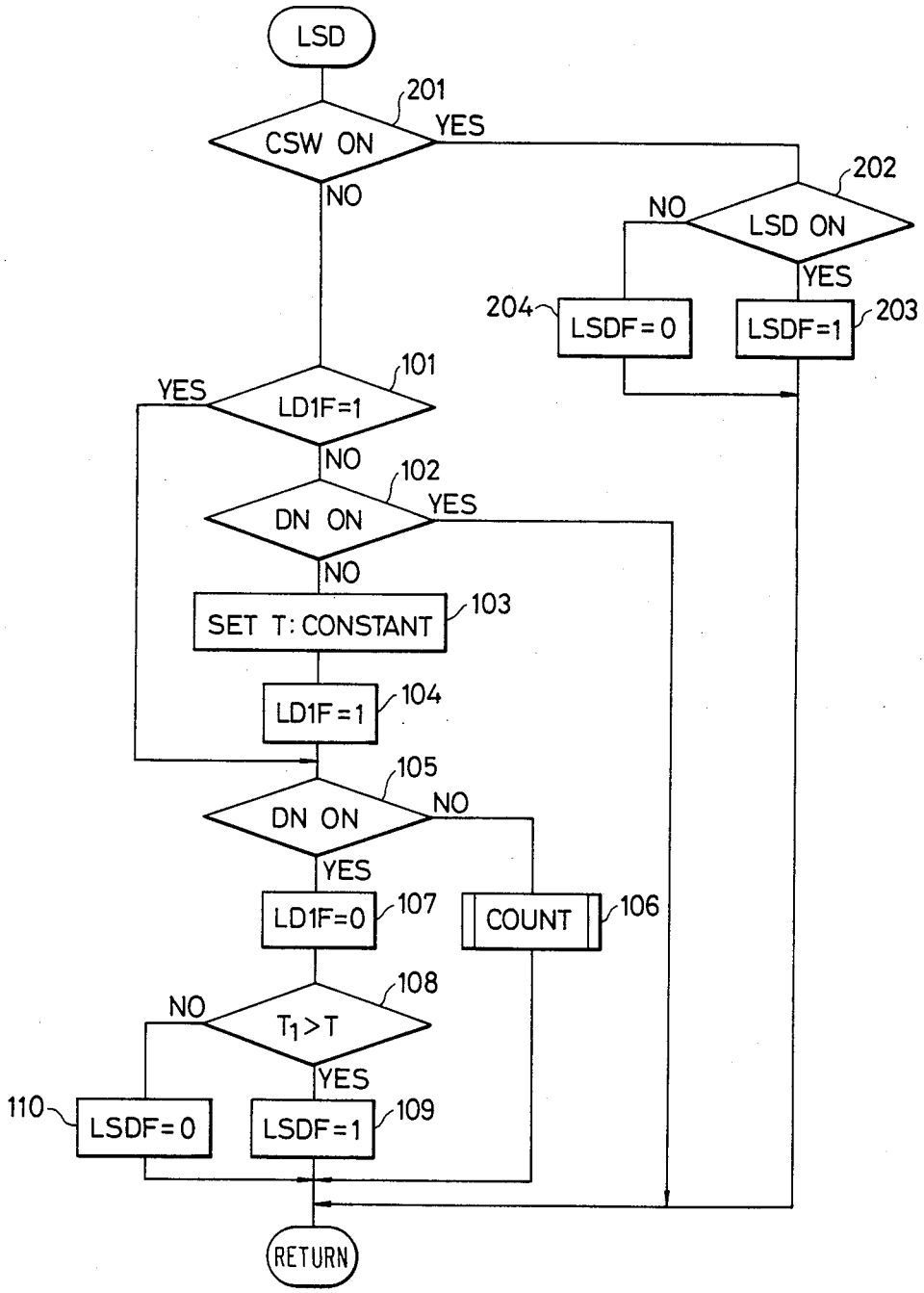
FIG. 5 is a flowchart of a program for detecting a stop-ready speed with the control system illustrated in FIG. 4.

The program shown in FIG. 5 includes a step 201 for determining whether the selector switch 14 is turned on or off. If the selector switch 14 is turned off, then the program goes to a step 101 which determines whether a timer has been set (stored) by way of LDIF. Thereafter, the same operation as shown in FIG. 3 is carried out according to the program contained in the control circuit 10.

If the selector circuit 14 is turned on in the step 201, then the program branches off to a step 202 which determines whether the external signal LSD is on or off. If the external signal LSD is on, that is, if the speed of operation of the sewing machine is below a stop-ready speed, then the program goes to step 203 in which LSDF is set to 1 as in the step 109. When the lower needle position signal DN is on, the control circuit 10 issues a command to energize the BK coil 31 to the SCU 12, which then issues the control signal BKS to thereby energize the BK coil 31. The sewing machine 21 is now braked and stopped in the lower needle position. If the external signal LSD is off in the step 202, then the speed of operation of the sewing machine 1 exceeds the stop-ready speed, and LSDF is set to 0 in a step 204 as in the step 110. The program now returns to an initial state without energizing the BK coil 31. Return of the program is shown by the step labeled "RETURN".

While in the foregoing embodiment the stop-ready speed is determined by using the lower needle position signal DN, the stop-ready speed can also be detemined by using the upper needle position signal UP or the speed detection signal PG.

With the arrangement of the present invention, as described above, the control system is provided with a capability of selecting the option of determining a stop-ready speed with the program stored in the control system, or the option of determining such a stop-ready speed with the external signal. Therefore, the control system can cope reliably with variations in the pulse durations of detected signals and the stop-ready speeds of different sewing machine types. The overall control system is relatively inexpensive as it requires only the selection capability.

Although a certain preferred embodiment has been shown and described, it should be understood that many changes and modifications may be made therein without departing from the scope of the appended claims.

I claim:

1. A control system for a sewing machine, comprising:

(a) a drive mechanism for driving the sewing machine;

(b) a brake mechanism for braking the sewing machine;

(c) control means for controlling said drive and brake mechanisms; and (d) detector means for generating signals indicative of detected positions of a needle of the sewing machine and a signal indicative of a detected speed of operation of the sewing machine, said control means comprising selector means for selecting either one of the options of detecting a predetermined stop-ready speed reached by the speed of operation of the sewing machine with a program stored in said control means or detecting such a stop-ready speed with an external signal issued from said detector means.

2. The control system according to claim 1, wherein said control means comprises a control circuit for receiving the signals indicative of needle positions and the signal indicative of the detected speed from said detector means, and a speed control unit responsive to a command from said control circuit for controlling said drive and brake mechanism, said control circuit comprising means for detecting said predetermined stop-ready speed reached by the speed of operation of the sewing machine.

3. The control system accoreing to claim 2, wherein said drive mechanism comprises a variable-speed motor including an electromagnetic brake serving as said brake mechanism.

4. The control system according to claim 2, further comprising a detector circuit for issuing an operation command signal to said control circuit and a speed command signal to said speed control unit in response to operation of an actuated member.

5. The control system according to claim 2, wherein said detector means includes a position detector for detecting the positions of the needle of the sewing machine and a speed detector for detecting the speed of operation of the sewing machine.

* * * * *